US008525436B2

(12) United States Patent
Lin et al.

(10) Patent No.: US 8,525,436 B2
(45) Date of Patent: Sep. 3, 2013

(54) LIGHT-EMITTING DIODE (LED) CURRENT BALANCE CIRCUIT

(75) Inventors: Li-Wei Lin, Zhonghe (TW); Chen-Chiang Lee, Zhonghe (TW); Chi-Hsin Lee, Zhonghe (TW); Yuan-Po Huang, Zhonghe (TW); Wen-Ming Lin, Zhonghe (TW)

(73) Assignee: Top Victory Investments Ltd., Harbour (HK)

( * ) Notice: Subject to any disclaimer, the term of this patent is extended or adjusted under 35 U.S.C. 154(b) by 330 days.

(21) Appl. No.: 12/954,958

(22) Filed: Nov. 29, 2010

(65) Prior Publication Data

US 2011/0127921 A1 Jun. 2, 2011

(30) Foreign Application Priority Data

Nov. 30, 2009 (TW) ..... 98140748 A

(51) Int. Cl.
*H05B 37/02* (2006.01)

(52) U.S. Cl.
USPC ..... 315/291; 315/209 R; 315/294; 315/297; 315/312

(58) Field of Classification Search
USPC ..... 315/209 R, 210, 224, 225, 226, 246, 315/291, 299
See application file for complete search history.

(56) References Cited

U.S. PATENT DOCUMENTS

| | | | | |
|---|---|---|---|---|
| 2009/0153066 | A1* | 6/2009 | Yang et al. | 315/192 |
| 2009/0295775 | A1* | 12/2009 | Kim et al. | 345/212 |
| 2010/0148679 | A1* | 6/2010 | Chen et al. | 315/185 R |
| 2010/0289424 | A1* | 11/2010 | Chang et al. | 315/250 |
| 2011/0148314 | A1* | 6/2011 | Lin et al. | 315/192 |

* cited by examiner

*Primary Examiner* — Douglas W Owens
*Assistant Examiner* — Jonathan Cooper
(74) *Attorney, Agent, or Firm* — Alan Kamrath; Kamrath IP Lawfirm, P.A.

(57) ABSTRACT

A light-emitting diode (LED) current balance circuit includes a reference current generator, a current mirror and a voltage compensation circuit. The reference current generator provides a reference current robust against disturbance in a supply voltage applied to the reference current generator. The current mirror generates, according to the reference current, sink currents to bias lightbars and employs a structure to reduce the influence of unmatched transistors on the sink currents to stabilize and clamp currents through the lightbar. The voltage compensation circuit detects the voltages across the lightbars to compensate the lightbars having various forward voltages to ensure the turn-on of all lightbars and to effectively balance the currents through the lightbars. Therefore, a simpler circuit architecture is employed which does not need a specific-purpose LED controller to be cheaper and more competitive.

12 Claims, 5 Drawing Sheets

LIGHT-EMITTING DIODE (LED) CURRENT BALANCE CIRCUIT

BACKGROUND OF THE INVENTION

1. Field of the Invention

The invention relates to a light-emitting diode (LED) driving circuit. More particularly, the invention relates to an LED current balance circuit for driving a plurality of lightbars each including a plurality of LEDs coupled in series.

2. Description of the Related Art

FIG. 1 is a diagram illustrating a conventional LED current balance circuit for a single lightbar. Referring to FIG. 1, a lightbar 11 includes a plurality of LEDs D1-Dn coupled in series, where n is a positive integer. A forward voltage Vf1 of the lightbar 11 is a total sum of forward voltages of the LEDs D1-Dn. The lightbar 11 has a first terminal coupled to a lightbar voltage VBUS and a second terminal coupled to an LED current balance circuit 1. The LED current balance circuit 1 includes a transistor Q, a resistor R and an operational amplifier OP. The resistor R detects a current through the lightbar 11 and accordingly generates a detecting result signal. The operational amplifier OP has an inverting terminal for receiving the detecting result signal (corresponding to the current through the lightbar 11), a non-inverting terminal for receiving a setting signal Vset (corresponding to a desired current) and an output terminal for outputting a control signal according to the difference between the current through the lightbar 11 and the desired current.

The transistor Q adjusts, according to the control signal outputted from the operational amplifier OP, its operating point to adjust a voltage drop across the transistor Q to further adjust the forward voltage Vf1 to cause the current through the lightbar 11 to follow the desired current. Therefore, a brightness of the lightbar 11 (corresponding to the current through the lightbar 11) is kept substantially constant and equal to a desired brightness (corresponding to the desired current) regardless of a tolerance of the forward voltage Vf1 of the lightbar 11 which is a total sum of tolerances of the forward voltages of the LEDs Dl-Dn even though they are manufactured in the same batch and the same process by the same manufacturer.

FIG. 2 is a diagram illustrating a conventional LED current balance circuit for a plurality of lightbars. Referring to FIG. 2, a plurality of lightbars 11-1m are employed, and each lightbar 1i is constructed such as the lightbar 11 shown in FIG. 1, where m is a positive integer and i is an integer from 1 to m. Each lightbar 1i has a first terminal coupled to a lightbar voltage VBUS and a second terminal coupled to a current balance unit (not shown) constructed such as the LED current balance circuit 1 shown in FIG. 1. The LED current balance circuit 2 includes a direct-current to direct-current (DC/DC) converter 21 and an LED controller 22. The DC/DC converter 21 converts a DC input voltage VIN to the lightbar voltage VBUS. The LED controller 22 includes the m current balance units coupled to the lightbars 11-1m through a plurality of channel terminals CH1-CHm. Accordingly, a current through each lightbar 1i will follow a desired current such as the desired current (corresponding to the setting signal Vset) shown in FIG. 1. In other words, the currents through the lightbars 11-1m are kept substantially constant and equal to each other to achieve current balance. However, as the number of the lightbars 11-1m increases, the number of the m current balance units increases, resulting in a cost and circuit size increase, and the effect of current balance becomes worse due to the increase in the number of the current balance units having their respective tolerance.

Recently, many specific-purpose integrated circuits (ICs) for the LED controller 22 have been developed. The specific-purpose LED controller IC integrates a fixed number of the current balance units and other functional units. For instance, a functional unit (not shown) in the LED controller 22 outputs a feedback signal through a feedback terminal FB to control the DC/DC converter 21 to adjust the lightbar voltage VBUS to provide feedback control to optimize the lightbar voltage VBUS applied to the lightbars 11-1m. Although the specific-purpose LED controller IC has the advantage of more accurate control and smaller circuit size, it has the disadvantage of higher cost, lower reliability and limited current and power ratings (typically less than 60mA). In a high-voltage and large-current LED lightbar application, there is a need for the specific-purpose LED controller IC to employ an external control manner by using some external components such as m transistor and m resistor for m lightbars so that cost and circuit size also increase as the number of the lightbars increases.

SUMMARY OF THE INVENTION

Accordingly, an LED current balance circuit is provided for driving a plurality of lightbars each including a plurality of LEDs coupled in series and for balancing currents through the lightbars by a simpler circuit architecture.

According to an aspect of the invention, an LED current balance circuit is provided. The LED current balance circuit drives a plurality of lightbars. Each lightbar includes a plurality of LEDs coupled in series, and each lightbar has a first terminal coupled to a lightbar voltage and a second terminal. The LED current balance circuit includes a current mirror, a reference current generator and a voltage compensation circuit. The current mirror balances currents through the lightbars by generating a plurality of sink currents according to a reference current and by causing each sink current to sink a current from the second terminal of a corresponding lightbar while the current mirror is enabled. The current mirror causes the currents through the lightbars to be zero while the current mirror is disabled. The reference current generator is coupled to the current mirror and is supplied power from a first supply voltage. The reference current generator provides the reference current and a second supply voltage. The reference current varies according to the first supply voltage while the first supply voltage is less than a constant-current threshold value to implement an analog dimming by enabling the current mirror and employing the first supply voltage with variable voltage as a dimming signal. The reference current is constant while the first supply voltage is greater than the constant-current threshold value to implement a digital dimming by employing a pulse-width modulation (PWM) signal with a variable pulse width as the dimming signal to alternatively enable and disable the reference current generator or the current mirror. The voltage compensation circuit is coupled to the second terminals of the lightbars and is supplied power from the second supply voltage. The voltage compensation circuit adjusts the lightbar voltage down while a voltage at the second terminal of one of the lightbars is greater than a compensation threshold value, and adjusts the lightbar voltage up while voltages at the second terminals of the lightbars are less than the compensation threshold value under the condition of the turn-on of all lightbars.

In one embodiment, the reference current generator includes a first bipolar junction transistor (BJT), an adjustable shunt regulator, a first resistor and a second resistor. The adjustable shunt regulator has a cathode terminal, an anode terminal and a reference terminal. A collector terminal of the first BJT is coupled to the first supply voltage and a first terminal of the first resistor. A base terminal of the first BJT is coupled to a second terminal of the first resistor and the cathode terminal of the adjustable shunt regulator. An emitter terminal of the first BJT is coupled to the reference terminal of the adjustable shunt regulator and a first terminal of the second resistor. The anode terminal of the adjustable shunt regulator is coupled to ground. A first terminal of the second resistor provides the second supply voltage. A second terminal of the second resistor provides the reference current.

In one embodiment, the voltage compensation circuit includes a plurality of first diodes, a second BJT, a third resistor, a fourth resistor, a fifth resistor, a sixth resistor, a seventh resistor, an eighth resistor and a first capacitor. A cathode terminal of each first diode is coupled to the second terminal of a corresponding lightbar. An anode terminal of each first diode is coupled to a first terminal of the third resistor and a first terminal of the fourth resistor. A second terminal of the third resistor is coupled to the second supply voltage and a first terminal of the fifth resistor. A second terminal of the fourth resistor and a second terminal of the fifth resistor are coupled to a base terminal and a collector terminal of the second BJT respectively. A first terminal and a second terminal of the sixth resistor are coupled to an emitter terminal of the second BJT and ground respectively. A first terminal of the seventh resistor is coupled to the collector terminal of the second BJT and a first terminal of the first capacitor. A second terminal of the seventh resistor is coupled to a first terminal of the eighth resistor. A second terminal of the eighth resistor is coupled to a second terminal of the first capacitor and ground. The first terminal of the eighth resistor provides a compensation signal for adjusting the lightbar voltage.

In the invention, the reference current generator provides the reference current robust against disturbance in the (first) supply voltage applied to the reference current generator. The current mirror balances the currents through the lightbars according to the reference current. The voltage compensation circuit detects the voltages across the lightbars to compensate the lightbars having various forward voltages to ensure the turn-on of all lightbars and effectively balance the currents through the lightbars. Therefore, the invention employs a simpler circuit architecture and does not need a specific-purpose LED controller, to be cheaper and more competitive.

BRIEF DESCRIPTION OF THE DRAWINGS

The foregoing and other features of the disclosure will be apparent and easily understood from a further reading of the specification and claims and by reference to the accompanying drawings in which:

DESCRIPTION OF THE PREFERRED EMBODIMENTS

Those skilled in the art should understand that a NPN bipolar junction transistor (BJT) has a first terminal (i.e. a collector terminal), a second terminal (i.e. an emitter terminal) and a control terminal (i.e. a base terminal); a N-channel field-effect transistor (FET) has a first terminal (i.e. a drain terminal), a second terminal (i.e. a source terminal) and a control terminal (i.e. a gate terminal); a resistor and a capacitor each has a first terminal and a second terminal; and, a diode, an LED and a Zener diode each has an anode terminal and a cathode terminal, which are not described again in the text which follows.

Figure 1:
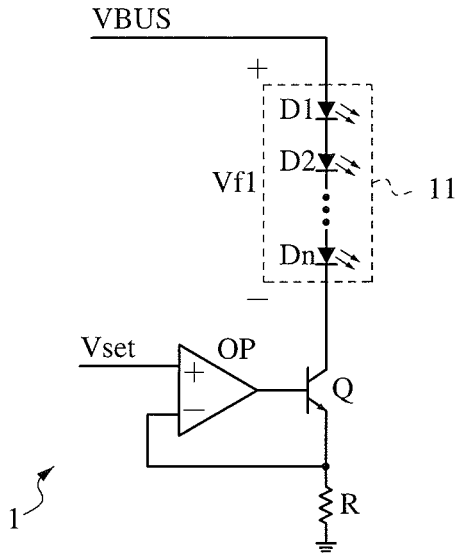
FIG.1 (Prior Art)
FIG. 1 is a diagram illustrating a conventional LED current balance circuit for a single lightbar.
Figure 2:
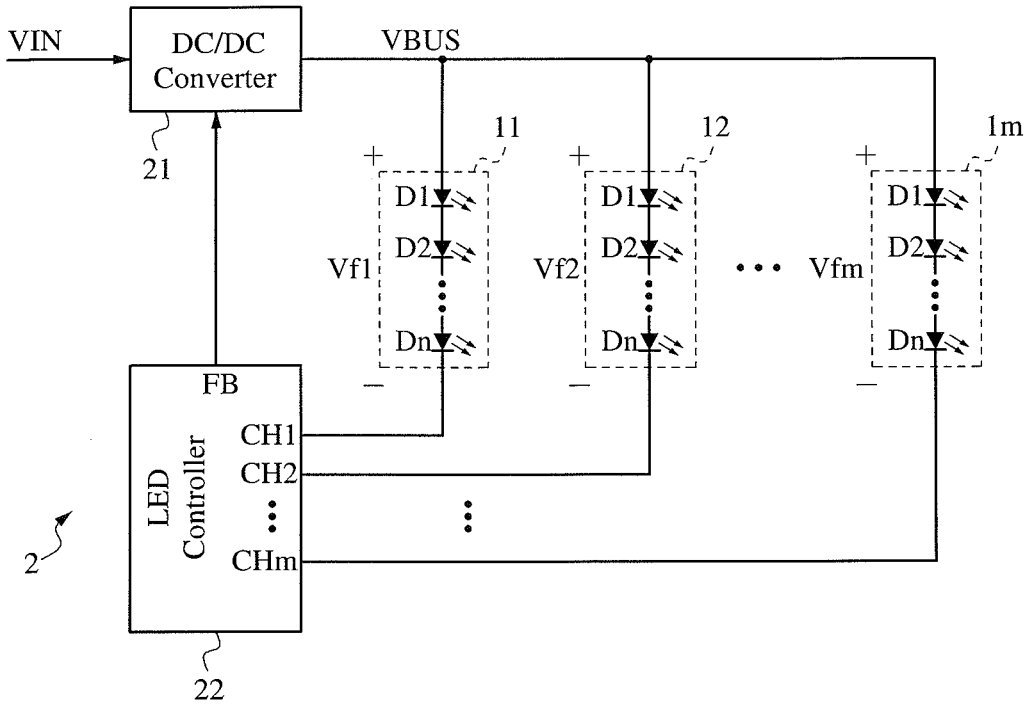
FIG.2 (Prior Art)
FIG. 2 is a diagram illustrating a conventional LED current balance circuit for a plurality of lightbars.
Figure 3:
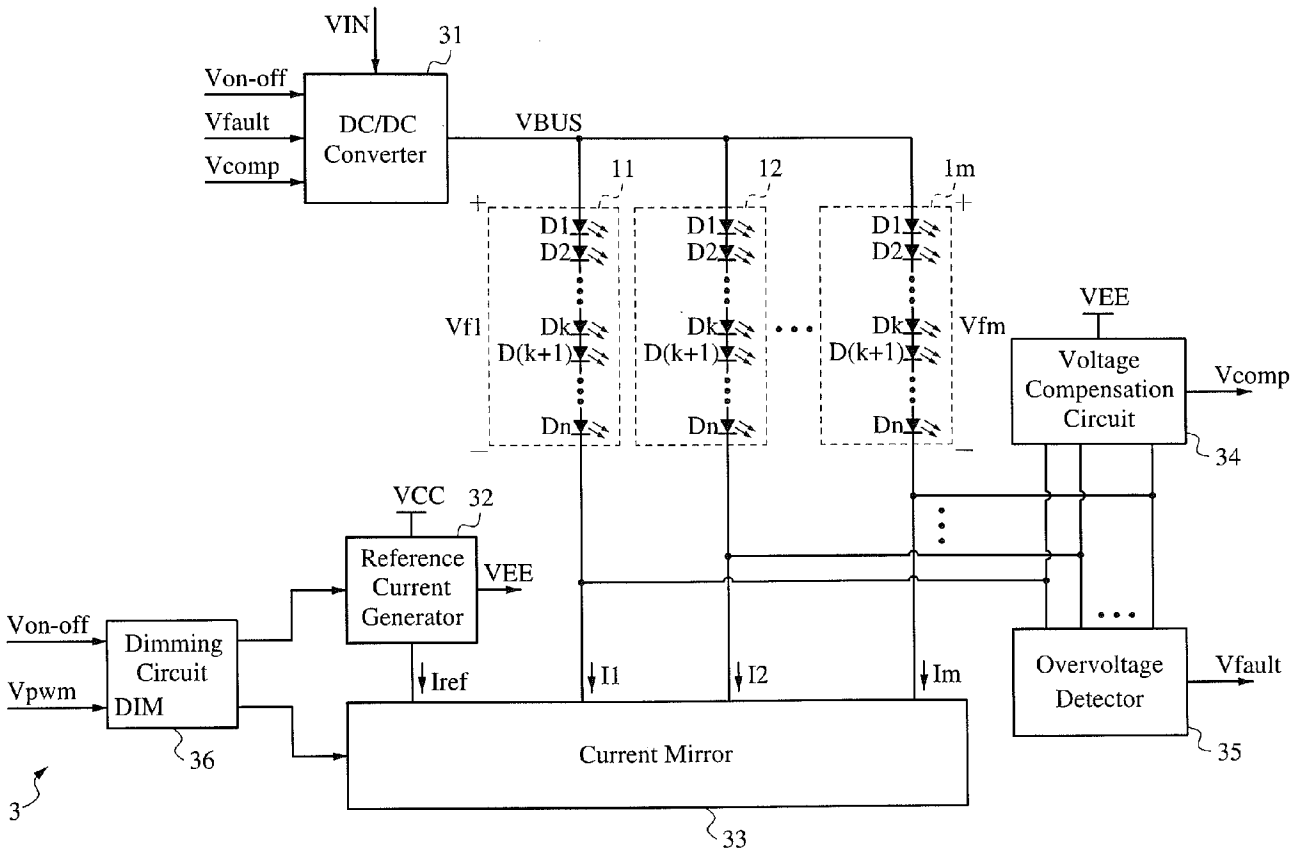
FIGS. 3 and 4 are a block diagram and a circuit diagram, respectively, illustrating an LED current balance circuit according to a preferred embodiment of the invention.
Figure 4:
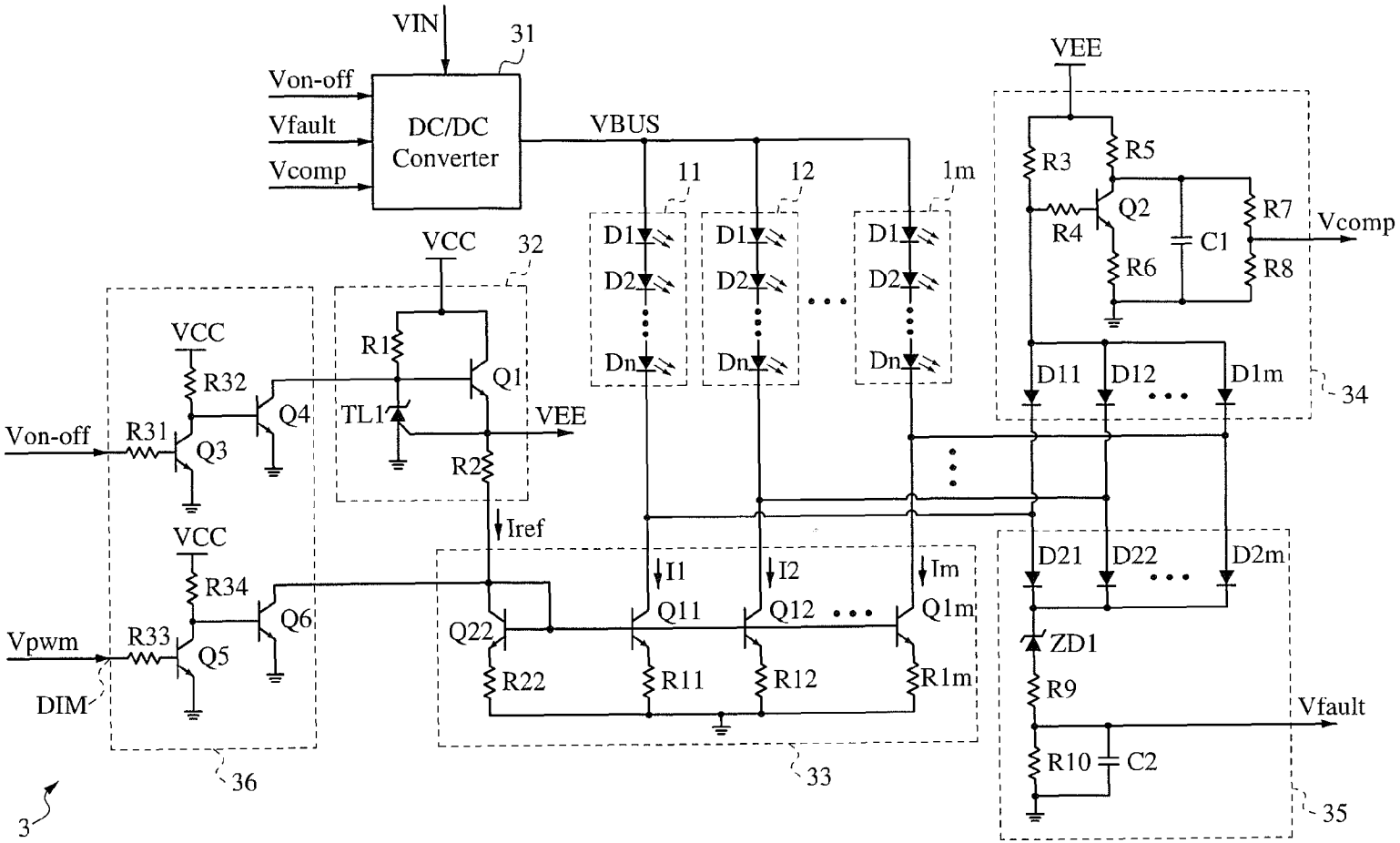

FIGS. 3 and 4 are a block diagram and a circuit diagram, respectively, illustrating an LED current balance circuit according to a preferred embodiment of the invention. Referring to FIGS. 3 and 4, an LED current balance circuit 3 drives a plurality of lightbars 11-1m, and each lightbar 1i includes a plurality of LEDs D1-Dn coupled in series, where m and n are positive integers, and i is an integer from 1 to m, which are not described again in the text which follows. Each lightbar 1i has a first terminal coupled to a lightbar voltage VBUS and a second terminal. Those skilled in the art should understand that the lightbars 11-1m will work well if each lightbar 1i satisfies that an anode terminal of the LED D1 is coupled to the first terminal of the lightbar 1i , a cathode terminal of the LED Dk is coupled to an anode terminal of the LED D(k+1), and a cathode terminal of the LED Dn is coupled to the second terminal of the lightbar 1i , where k is an integer from 1 to (n−1). The lightbars 11-1m may be employed as a direct-light-type or edge-light-type backlight of a liquid crystal display (LCD).

The LED current balance circuit 3 includes a DC/DC converter 31, a reference current generator 32, a current mirror 33, a voltage compensation circuit 34, an overvoltage detector 35 and a dimming circuit 36.

The DC/DC converter 31 such as a bulk or boost converter converts a DC input voltage VIN such as 5V, 12V or 24V provided by a general-purpose power supply (not shown) to the lightbar voltage VBUS sufficient to drive the lightbars 11-1m. The DC/DC converter 31 further receives a power on/off signal Von-off, a fault signal Vfault and a compensation signal Vcomp. The power on/off signal Von-off at high level, for example, enables the DC/DC converter 31 so that the DC/DC converter 31 provides the lightbar voltage VBUS to supply power to the lightbars 11-m and a first supply voltage VCC to supply power to internal components of the LED current balance circuit 3. Conversely, the power on/off signal Von-off at low level disables the DC/DC converter 31 so that the DC/DC converter 31 does not supply power anymore.

Figure 5:
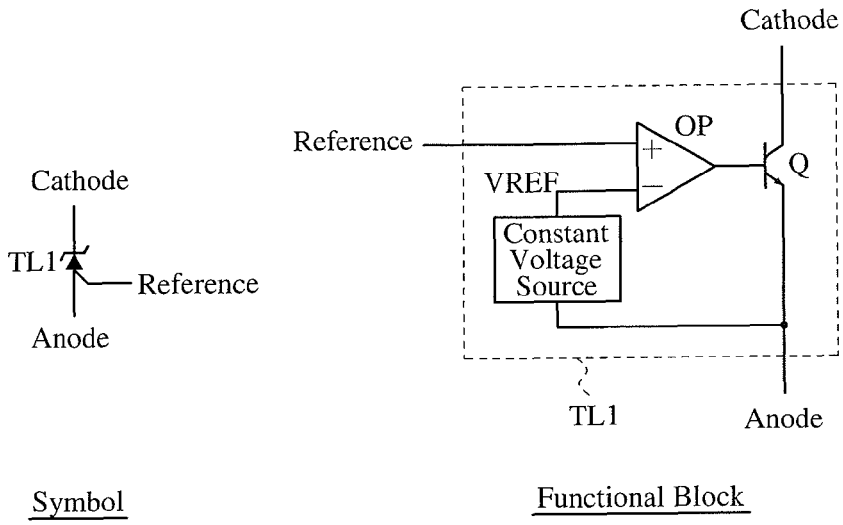
FIG. 5 is a diagram illustrating the symbol and functional block diagram of the adjustable shunt regulator shown in FIG. 4.

The reference current generator 32 is coupled to the current mirror 33 and supplied power from the first supply voltage VCC. In the embodiment, the reference current generator 32 includes a first BJT Q1, an adjustable shunt regulator TL1, a first resistor R1 and a second resistor R2. The adjustable shunt regulator TL1 is a TL431 IC manufactured by Texas Instruments Inc. FIG. 5 is a diagram illustrating the symbol and functional block diagram of the adjustable shunt regulator TL1 shown in FIG. 4. Referring to FIG. 5, the adjustable shunt regulator TL1 has a cathode terminal, an anode terminal and a reference terminal. The adjustable shunt regulator TL1 includes a constant voltage source, a transistor Q and an operational amplifier OP. The constant voltage source provides a reference voltage VREF (typically 2.5V for TL431). The operational amplifier OP has an inverting terminal coupled to the reference voltage VREF, a non-inverting terminal coupled to the reference terminal and an output terminal coupled to a base terminal of the transistor Q. A collector terminal and an emitter terminal of the transistor Q are coupled to the cathode terminal and the anode terminal respectively. A current through the transistor Q is a stable non-saturation current while a voltage at the reference terminal is very close to the reference voltage VREF, and the current through the transistor Q varies within a range of 1 A to 100 mA as the voltage at the reference terminal slightly varies relative to the reference voltage VREF.

Referring back to FIGS. 3 and 4, in the reference current generator 32, a collector terminal of the first BJT Q1 is coupled to the first supply voltage VCC and a first terminal of the first resistor R1. A base terminal of the first BJT Q1 is coupled to a second terminal of the first resistor R1 and the cathode terminal of the adjustable shunt regulator TL1. An emitter terminal of the first BJT Q1 is coupled to the reference terminal of the adjustable shunt regulator TL1 and a first terminal of the second resistor R2. The anode terminal of the adjustable shunt regulator TL1 is coupled to ground. A first terminal of the second resistor R2 provides a second supply voltage VEE for supplying power to the voltage compensation circuit 34. A second terminal of the second resistor R2 provides a reference current Iref.

While the first supply voltage VCC is greater than a constant-current threshold value, the first BJT Q1 is conducted, and the adjustable shunt regulator TL1 is normally operated, so that a voltage at the reference terminal of the adjustable shunt regulator TL1 (i.e. the second supply voltage VEE) is substantially a constant voltage. If a resistance of the second resistor R2 is determined, the reference current Iref provided from the reference current generator 32 will be determined and substantially constant, and a voltage at the second terminal of the second resistor R2 is determined and substantially constant. The current mirror 33 is operated more stably while being biased by the constant current (Iref) and the constant voltage provided from the reference current generator 32. In the embodiment, a collector-emitter voltage of the first BJT Q1 while being conducted is about 1V, the voltage at the reference terminal of the adjustable shunt regulator TL1 is about 2.5V, and the constant-current threshold value is therefore about 3.5V. In addition, the first supply voltage VCC, of course, has an upper limit which is mainly determined by maximum current and power ratings of the first BJT Q1.

The current mirror 33 is coupled to the reference current generator 32 and the second terminals of the lightbar 11-1m. While the current mirror 33 is enabled, the current mirror 33 balances currents through the lightbars 11-1m by generating a plurality of sink currents 11-1m according to the reference current Iref and by causing each sink current 1i to sink a current from the second terminal of a corresponding lightbar 1i. While the current mirror 33 is disabled, the current mirror 33 causes the currents through the lightbars 11-1m to be zero.

In the embodiment, the current mirror 33 includes a plurality of first transistors Q11-Q1m matched to each other and a second transistor Q22. The first transistors Q11-Q1m and the second transistor Q22 employed here are, but are not limited to, NPN BJTs. The transistors Q11-Q1m and Q22 may be, for example, N-channel FETs. The first terminal of each first transistor Q11 is coupled to the second terminal of a corresponding lightbar 1i for sinking a corresponding sink current 1i from the corresponding lightbar 1i . The first terminal and the control terminal of the second transistor Q22 are coupled to each other so that the second transistor Q22 forms a diode-connected transistor. The first terminal of the second transistor Q22 is further coupled to the second terminal of the second resistor R2 of the reference current generator 32 for receiving the reference current Iref. The second terminals of the first transistors Q11-Q1m and the second transistor Q22 are coupled to ground. The control terminals of the first transistors Q11-Q1m and the second transistor Q22 are coupled to each other. While the current mirror 33 is enabled, the sink currents I1-Im are substantially equal to each other due to the matched first transistors Q11-Q1m to cause the currents through the lightbars 11-1m to be substantially equal to each other so that the lightbars 11-1m can provide stable and uniform brightness.

In the embodiment, the second terminal of each first transistor Q1i is coupled to ground through a corresponding resistor R1i, and the second terminal of the second transistor Q22 is coupled to ground through a corresponding resistor R22. The resistors R11-Rlm can reduce the influence of the unmatched first transistors Q11-Q1m on the sink currents I1-Im. While the control terminal of the second transistor Q22 is coupled to ground, the first transistors Q11-Q1m and the second transistor Q22 are cut off to achieve the disablement of the current mirror 33. While the control terminal of the second transistor Q22 is not coupled to ground, the first transistors Q11-Q1m and the second transistor Q22 are operated normally to achieve the enablement of the current mirror 33.

The voltage compensation circuit 34 includes a plurality of first diodes D11-D1m, a second BJT Q2, a third resistor R3, a fourth resistor R4, a fifth resistor R5, a sixth resistor R6, a seventh resistor R7, an eighth resistor R8 and a first capacitor C1. A cathode terminal of each first diode D1i is coupled to the second terminal of a corresponding lightbar 1i. An anode terminal of each first diode D1i is coupled to a first terminal of the third resistor R3 and a first terminal of the fourth resistor R4. A second terminal of the third resistor R3 is coupled to the second supply voltage VEE and a first terminal of the fifth resistor R5. A second terminal of the fourth resistor R4 and a second terminal of the fifth resistor R5 are coupled to a base terminal and a collector terminal of the second BJT Q2 respectively. A first terminal and a second terminal of the sixth resistor R6 are coupled to an emitter terminal of the second BJT Q2 and ground respectively. A first terminal of the seventh resistor R7 is coupled to the collector terminal of the second BJT Q2 and a first terminal of the first capacitor C1. A second terminal of the seventh resistor R7 is coupled to a first terminal of the eighth resistor R8. A second terminal of the eighth resistor R8 is coupled to a second terminal of the first capacitor C1 and ground. The first terminal of the eighth resistor R8 provides the compensation signal Vcomp for adjusting the lightbar voltage VBUS.

It is assumed that each lightbar 1i includes 13 LEDs and that a voltage at the second terminal of each lightbar 1i (or a voltage across the first transistor Q1i and the resistor R1i of the current mirror 33) is 1V. Ideally, a forward voltage of each LED is 3.3V so that a forward voltage Vfi of the lightbar 1i is 42.9V (=3.3V×13) and so that the lightbar voltage VBUS is 43.9V. However, in fact, the forward voltages Vf1-Vfm of the lightbars 11-1m are different. Some (such as the lightbar 11) are greater than 42.9V, and the others (such as the lightbar 12) are slightly less than 42.9V. To ensure the turn-on of all lightbars 11-1m, the lightbar voltage VBUS should be slightly greater than 43.9V to turn on the lightbar 11 (which is a representative of the lightbars whose forward voltages are greater than 42.9V), but it results that the lightbar 12 (which is a representative of the lightbars whose forward voltages are less than 42.9V) has a higher voltage at its second terminal. Hence, the total voltage drop across the first transistor Q11 and the resistor R11 becomes larger to dissipate more power and reduce useful life. The invention employs the voltage compensation circuit 34 to adjust the lightbar voltage VBUS to reduce the power dissipation of the current mirror 33 under the condition of the turn-on of all lightbars 11-1m.

It is assumed that a forward voltage of each first diode D1i is 0.7V. Ideally, the voltage at the second terminal of each lightbar 1i is 1V, and, then, a voltage at the anode terminal of each first diode D1i is 1.7V. While a voltage at the second terminal of one of the lightbars 11-1m (or a total voltage drop across one first transistor and a corresponding resistor) is greater than 1V to bring more power dissipation in the current mirror 33, the voltage at the anode terminal of the first diode D1i is greater than 1.7V (defined as a compensation threshold value). Accordingly, the second BJT Q2 is designed to be conducted to cause a voltage across the capacitor C1 to fall so that the voltage across the capacitor C1 is divided by the resistors R7 and R8 to generate the compensation signal Vcomp. Conversely, while the voltages at the second terminals of the lightbars 11-1m are all less than 1V, the voltage at the anode terminal of the first diode D1i is less than 1.7V, and the second BJT Q2 is cut off so that the second supply voltage VEE is divided by the resistors R5, R7 and R8 to generate the compensation signal Vcomp. According to the compensation signal Vcomp, under the condition of the turn-on of all lightbars 11-1m, the DC/DC converter 31 decreases or adjusts the lightbar voltage VBUS down while the voltages at the second terminals of the lightbars 11-1m are all less than the compensation threshold value, and increases or adjusts the lightbar voltage VBUS up while the voltage at the second terminal of one of the lightbars 11-1m is greater than the compensation threshold value. In addition, the compensation threshold value can be expressed as $(VEE-Vbe2)\times[R4+(1+\beta)\times R6]/[R3+R4+(1+\beta)\times R6]$, where Vbe2 is a base-emitter voltage of the second BJT Q2 and 13 is a common-emitter current gain of the second BJT Q2.

The overvoltage detector 35 is coupled to the second terminals of the lightbars 11-1m. The overvoltage detector 35 provides the fault signal Vault while the overvoltage detector 35 detects if a voltage at the second terminal of one of the lightbars 11-1m is greater than an overvoltage threshold value, and the fault signal Vault causes the lightbar voltage VBUS to be zero.

In the embodiment, the overvoltage detector 35 includes a plurality of second diodes D21-D2m, a Zener diode ZD1, a ninth resistor R9, a tenth resistor R10 and a second capacitor C2. An anode terminal of each second diode D2i is coupled to the second terminal of a corresponding lightbar 1i. A cathode terminal of each second diode D2i is coupled to a cathode terminal of the Zener diode ZD1. An anode terminal of the Zener diode ZD1 is coupled to a first terminal of the ninth resistor R9. A second terminal of the ninth resistor R9 is coupled to a first terminal of the tenth resistor R10 and a first terminal of the second capacitor C2. A second terminal of the tenth resistor R10 is coupled to a second terminal of the second capacitor C2 and ground. The first terminal of the tenth resistor R10 provides the fault signal Vfault while the overvoltage detector 35 detects if a voltage at the second terminal of one of the lightbars 11-1m is greater than the overvoltage threshold value. While a voltage at the second terminal of one lightbar (such as the lightbar 11) is greater than the overvoltage threshold value, the Zener diode ZD1 is operated in a reverse breakdown region, and a voltage which is the voltage at the second terminal of the lightbar 11 minus the sum of the forward voltage of the second diode D21 and the breakdown voltage of the Zener diode ZD1 is dropped across the ninth resistor R9 and the tenth resistor R10, so that the voltage dropped across the tenth resistor R10 is designed to be a high level to represent that the fault signal Vfault is outputted. Converserly, while the voltages at the second terminals of the lightbars 11-1m are all less than the overvoltage threshold value, the Zener diode ZD1 is operated in a reverse region but not in a reverse breakdown region, and there is no voltage dropped across the ninth resistor R9 and the tenth resistor R10, so that the voltage dropped across the tenth resistor R10 is zero or at low level to represent that the fault signal Vfault is not outputted. In addition, the overvoltage threshold value can be determined by using the Zener diode ZD1 with a specific breakdown voltage.

While the first supply voltage VCC is greater than the constant-current threshold value, the reference current Iref provided from the reference current generator 32 is constant so that the sink currents I1-Im are constant to cause the currents through the lightbars 11-1m to be constant while the current mirror 33 is enabled. That is, the lightbars 11-1m provide constant brightness. The LED current balance circuit 3 must employ a digital dimming to implement the brightness adjustment function of the lightbars 11-1m. The digital dimming is implemented by alternatively enabling and disabling the current mirror 33 (or the reference current generator 32) to alternatively turn on and turn off the lightbars 11-1m in turn. By using the persistence of vision, a human eye may only perceive an average brightness based on the ratio of the turn-on period and the turn-off periods period of the lightbars 11-1m (corresponding to the ratio of the enablement period and the disablement periods period of the current mirror 33 or the reference current generator 32).

In the embodiment, the current mirror 33 is alternatively enabled and disabled through the dimming circuit 36. The dimming circuit 36 is coupled to the reference current generator 32 and the current mirror 33. The dimming circuit 36 receives a pulse-width modulation (PWM) signal Vpwm through a dimming terminal DIM of the dimming circuit 36 and alternatively enables and disables the current mirror 33 according to the PWM signal Vpwm. The ratio of the enablement period and the disablement period of the current mirror 33 can be determined by adjusting a pulse width (or a duty cycle) of the PWM signal Vpwm. Accordingly, the digital dimming is implemented by employing the PWM signal Vpwm with a variable pulse width as a dimming signal.

In the embodiment, the dimming circuit 36 includes transistor switches Q3-Q6 and resistors R31-R34. While the PWM signal Vpwm is at a low level, the transistor switch Q5 is turned off and the transistor switch Q6 is turned on so that the base terminals of the transistors Q11-Q1m and Q22 of the current mirror 33 are coupled to ground, the transistors Q11-Q1m and Q22 are cut off, the sink currents I11-I1m are not generated, and the current mirror 33 is disabled. While the PWM signal Vpwm is at a high level, the transistor switch Q5 is turned on, and the transistor switch Q6 is turned off, so that the dimming circuit 36 does not influence the operation of the current mirror 33 and so that the current mirror 33 is enabled. Moreover, while the power on/off signal Von-off is at a low level, the transistor switch Q3 is turned off, and the transistor switch Q4 is turned on, so that the base terminal of the first BJT Q1 of the reference current generator 32 is coupled to the ground, the first BJT Q1 is cut off, the cathode terminal and the anode terminal of the adjustable shunt regulator TL1 are coupled to ground, the reference current Iref and the second supply voltage VEE are zero, and the reference current generator 32 is disabled. While the power on/off signal Von-off is at a high level, the transistor switch Q3 is conducted, and the transistor switch Q4 is cut off, so that the dimming circuit 36 does not influence the operation of the reference current generator 32 and so that the reference current generator 32 is enabled.

Figure 6A:
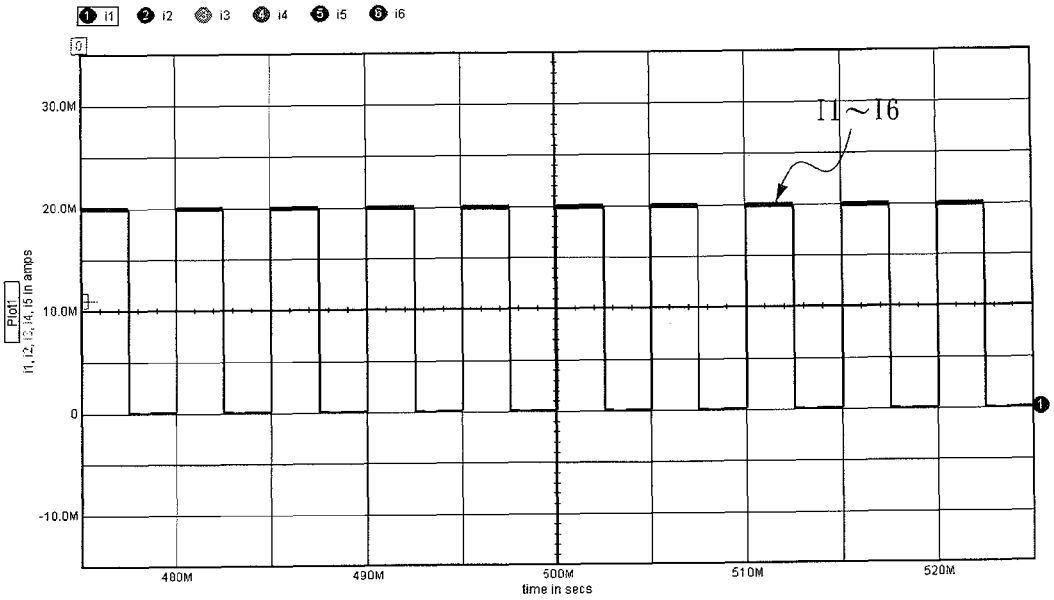
FIGS. 6A and 6B are waveform diagrams illustrating simulation results for the LED current balance circuit shown in FIG. 4.
Figure 6B:
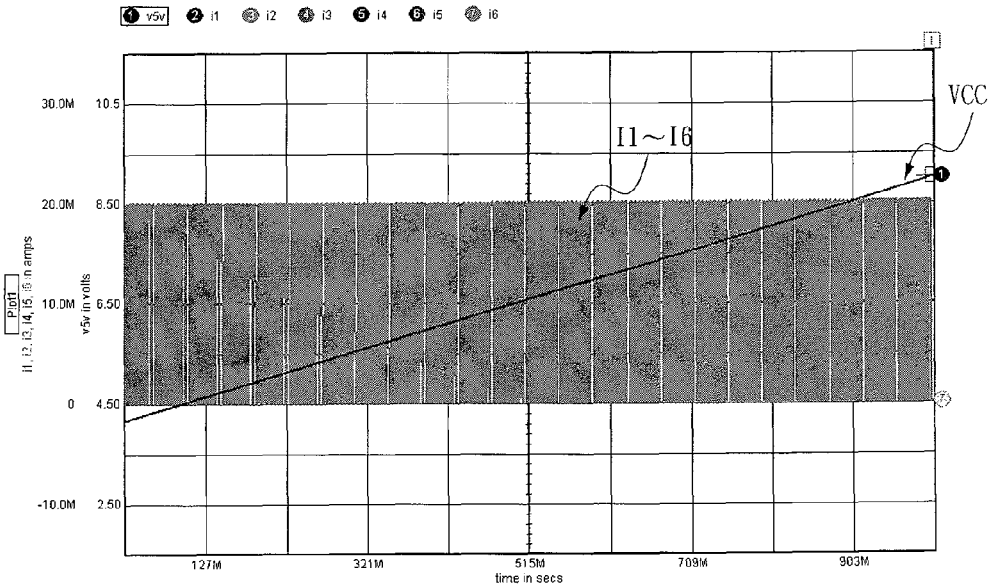

FIGS. 6A and 6B are waveform diagrams illustrating simulation results for the LED current balance circuit shown in FIG. 4. It is simulated under the condition that the LED current balance circuit 3 drives 6 lightbars 11-16, the currents 11-16 through the lightbars 11-16 each is 20 mA, and the duty cycle of the PWM signal Vpwm is 50%. First, referring to FIG. 6A, it is simulated under the condition that the first supply voltage VCC is constant and equal to 5V. It is observed that the sink currents I1-I6 (correspond to the currents through the lightbars 11-16) are kept substantially constant and equal to 20 mA to achieve current balance while the current mirror 33 is enabled. Accordingly, the lightbars 11-16 provide stable and uniform brightness. Next, referring to FIG. 6B, it is simulated under the condition that the first supply voltage VCC is 5V with a disturbance within a range of 4V to 9V. It is observed that the sink currents I1-I6 are kept substantially constant and equal to 20 mA so that the LED current balance circuit 3 are robust against the disturbance in the first supply voltage VCC.

Figure 7:
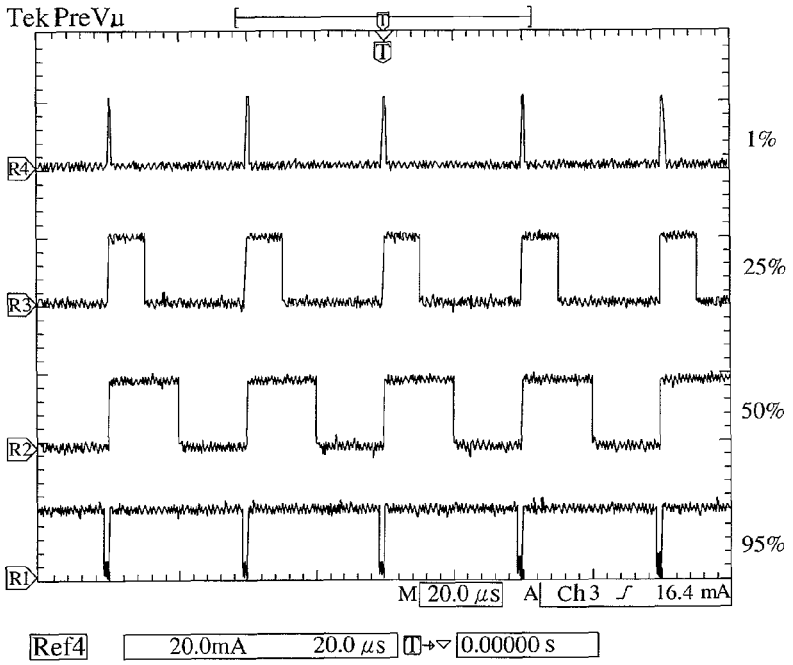
FIG. 7 is a waveform diagram illustrating experimental results for the LED current balance circuit shown in FIG. 4.

FIG. 7 is a waveform diagram illustrating experimental results for the LED current balance circuit shown in FIG. 4. It is experimentally measured under the condition that the LED current balance circuit 3 drives 6 lightbars 11-16 and that the currents I1-I6 through the lightbars 11-16 each is 20 mA. Referring to FIG. 7, it is a measured waveform diagram illustrating a current through one lighbar under the condition that the duty cycles of the PWM signal Vpwm are 1%, 25%, 50% and 95%, respectively. It is observed that while the duty cycle (or pulse width) of the PWM signal Vpwm is changed, the enablement period of the current mirror 33 is changed according to the pulse width of the PWM signal Vpwm. The current through the lighbar, while the current mirror 33 is enabled, is kept substantially constant and equal to 20 mA so that the LED current balance circuit 3 provides a good dimming linearity. In addition, the measured currents I1-I6 through the lightbars 11-16 are 19.8 mA, 19.8 mA, 19.9 mA, 19.9 mA, 20.1 mA and 20.0 mA, respectively, so that the LED current balance circuit 3 provides a good current regulation of about 1.5%.

The above-mentioned dimming for the LED current balance circuit 3 is the digital dimming (called PWM dimming). However, the LED current balance circuit 3 can be changed to employ analog dimming. The analog dimming is implemented by enabling the current mirror 33 and employing the first supply voltage VCC with variable voltage less than the constant-current threshold value as a dimming signal. While the first supply voltage VCC is less than the constant-current threshold value, the first BJT Q1 is cut off, and the reference current Iref varies according to the first supply voltage VCC to implement the analog dimming by employing the variable first supply voltage VCC as the dimming signal. It is noted that while employing the analog dimming, the dimming circuit 36 used in the digital dimming must be inactive by setting the PWM signal Vpwm received from the dimming terminal DIM always at high level. Alternately, the dimming circuit 36 used in the digital dimming must be removed, so that the current mirror 33 is always enabled while the LED current balance circuit 3 is operated normally.

Furthermore, the LED current balance circuit 3 can be changed to employ a mixing dimming combined by the analog and digital dimmings to achieve higher brightness contrast. The mixing dimming is implemented by the first supply voltage VCC being further coupled to the dimming terminal DIM and the PWM signal Vpwm being received through the dimming terminal DIM. While the duty cycle of the PWM signal Vpwm (such as 50%) is greater than a duty-cycle threshold value (such as 20%), the PWM signal Vpwm at an enablement period (such as at a high level) is a constant voltage and greater than the constant-current threshold value, the LED current balance circuit 3 behaves like the digital dimming. While the duty cycle of the PWM signal Vpwm (such as 10%) is less than the duty-cycle threshold value (such as 20%), the PWM signal Vpwm at the enablement period is a variable voltage and less than the constant-current threshold value, and the variable voltage decreases as the duty cycle of the PWM signal Vpwm. The LED current balance circuit 3 behaves like the digital dimming as well as the analog dimming to achieve higher brightness contrast under the condition lower brightness.

In summary, in the invention, the reference current generator provides the reference current robust against disturbance in the (first) supply voltage applied to the reference current generator. The current mirror generates, according to the reference current, the sink currents to bias the lightbars and employs a structure to reduce the influence of the unmatched first transistors on the sink currents to stabilize and clamp the currents through the lightbar. The voltage compensation circuit detects the voltages across the lightbars to compensate the lightbars having various forward voltages to ensure the turn-on of all lightbars and to effectively balance the currents through the lightbars. Therefore, the invention employs a simpler circuit architecture and does not need a specific-purpose LED controller, to be cheaper and more competitive.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

We claim:

1. A light-emitting diode (LED) current balance circuit for driving a plurality of lightbars, each lightbar comprising a plurality of LEDs coupled in series, each lightbar having a first terminal coupled to a lightbar voltage and a second terminal, the LED current balance circuit comprising:

a current mirror for balancing currents through the lightbars by generating a plurality of sink currents according to a reference current and causing each sink current to sink a current from the second terminal of a corresponding lightbar while being enabled, and causing the currents through the lightbars to be zero while being disabled;

a reference current generator coupled to the current mirror and supplied power from a first supply voltage for providing the reference current and a second supply voltage, the reference current varying according to the first supply voltage while the first supply voltage is less than a constant-current threshold value to implement an analog dimming by enabling the current mirror and employing the first supply voltage with variable voltage as a dimming signal, the reference current being constant while the first supply voltage is greater than the constant-current threshold value to implement a digital dimming by employing a pulse-width modulation (PWM) signal with a variable pulse width as the dimming signal to alternatively enable and disable the reference current generator or the current mirror; and a voltage compensation circuit coupled to the second terminals of the lightbars and supplied power from the second supply voltage for adjusting the lightbar voltage down while a voltage at the second terminal of one of the lightbars is greater than a compensation threshold value and adjusting the lightbar voltage up while voltages at the second terminals of the lightbars are less than the compensation threshold value under the condition of the turn-on of all lightbars.

2. The LED current balance circuit according to claim 1, wherein the current mirror comprises a plurality of first transistors matched to each other and a second transistor, each of the first transistors and the second transistor having a first terminal, a second terminal and a control terminal, the first terminal of each first transistor being coupled to the second terminal of a corresponding lightbar for sinking a corresponding sink current from the corresponding lightbar, the first terminal of the second transistor being coupled to the control terminal of the second transistor and the reference current generator for receiving the reference current, the second terminals of the first transistors and the second transistor being coupled to ground, the control terminals of the first transistors and the second transistor being coupled to each other.

3. The LED current balance circuit according to claim 2, wherein each of the first transistors and the second transistor comprises a bipolar junction transistor (BJT) or a field-effect transistor (FET).

4. The LED current balance circuit according to claim 2, wherein the second terminal of each of the first transistors and the second transistor is coupled to ground through a corresponding resistor.

5. The LED current balance circuit according to claim 2, wherein the current mirror is enabled while the control terminal of the second transistor is not coupled to ground, and disabled while the control terminal of the second transistor is coupled to ground.

6. The LED current balance circuit according to claim 1, further comprising an overvoltage detector coupled to the second terminals of the lightbars for providing a fault signal while detecting if the voltage at the second terminal of one of the lightbars is greater than an overvoltage threshold value, the fault signal causing the lightbar voltage to be zero.

7. The LED current balance circuit according to claim 6, wherein the overvoltage detector comprises a plurality of second diodes, a Zener diode, a ninth resistor, a tenth resistor and a second capacitor, an anode terminal of each second diode being coupled to the second terminal of a corresponding lightbar, a cathode terminal of each second diode being coupled to a cathode terminal of the Zener diode, an anode terminal of the Zener diode being coupled to a first terminal of the ninth resistor, a second terminal of the ninth resistor being coupled to a first terminal of the tenth resistor and a first terminal of the second capacitor, a second terminal of the tenth resistor being coupled to a second terminal of the second capacitor and ground, the first terminal of the tenth resistor providing the fault signal while detecting if the voltage at the second terminal of one of the lightbars is greater than the overvoltage threshold value.

8. The LED current balance circuit according to claim 1, wherein the reference current generator comprises a first bipolar junction transistor (BJT), an adjustable shunt regulator, a first resistor and a second resistor, the adjustable shunt regulator having a cathode terminal, an anode terminal and a reference terminal, a collector terminal of the first BJT being coupled to the first supply voltage and a first terminal of the first resistor, a base terminal of the first BJT being coupled to a second terminal of the first resistor and the cathode terminal of the adjustable shunt regulator, an emitter terminal of the first BJT being coupled to the reference terminal of the adjustable shunt regulator and a first terminal of the second resistor, the anode terminal of the adjustable shunt regulator being coupled to ground, a first terminal of the second resistor providing the second supply voltage, a second terminal of the second resistor providing the reference current.

9. The LED current balance circuit according to claim 8, wherein the voltage compensation circuit comprises a plurality of first diodes, a second BJT, a third resistor, a fourth resistor, a fifth resistor, a sixth resistor, a seventh resistor, an eighth resistor and a first capacitor, a cathode terminal of each first diode being coupled to the second terminal of a corresponding lightbar, an anode terminal of each first diode being coupled to a first terminal of the third resistor and a first terminal of the fourth resistor, a second terminal of the third resistor being coupled to the second supply voltage and a first terminal of the fifth resistor, a second terminal of the fourth resistor and a second terminal of the fifth resistor being coupled to a base terminal and a collector terminal of the second BJT respectively, a first terminal and a second terminal of the sixth resistor being coupled to an emitter terminal of the second BJT and ground respectively, a first terminal of the seventh resistor being coupled to the collector terminal of the second BJT and a first terminal of the first capacitor, a second terminal of the seventh resistor being coupled to a first terminal of the eighth resistor, a second terminal of the eighth resistor being coupled to a second terminal of the first capacitor and ground, the first terminal of the eighth resistor providing a compensation signal for adjusting the lightbar voltage.

10. The LED current balance circuit according to claim 9, wherein while the first supply voltage is less than the constant-current threshold value, the first BJT is cut off, and the reference current and the second supply voltage vary according to the first supply voltage.

11. The LED current balance circuit according to claim 9, wherein while the first supply voltage is greater than the constant-current threshold value, the first BJT is conducted, and the reference current and the second supply voltage are constant, wherein the LED current balance circuit further comprises a dimming circuit coupled to the reference current generator or the current mirror for receiving the PWM signal through a dimming terminal of the dimming circuit and alternatively enabling and disabling the reference current generator or the current mirror according to the PWM signal.

12. The LED current balance circuit according to claim 11, wherein the first supply voltage is further coupled to the dimming terminal, wherein the PWM signal at an enablement period is a constant voltage and greater than the constant-current threshold value while a duty cycle of the PWM signal is greater than a duty-cycle threshold value, and the PWM signal at the active-high period is a variable voltage and less than the constant-current threshold value while the duty cycle of the PWM signal is less than the duty-cycle threshold value.

* * * * *